US008517667B1

(12) United States Patent
Liang

(10) Patent No.: US 8,517,667 B1
(45) Date of Patent: Aug. 27, 2013

(54) TURBINE VANE WITH COUNTER FLOW COOLING PASSAGES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 543 days.

(21) Appl. No.: 12/951,560

(22) Filed: Nov. 22, 2010

(51) Int. Cl.
*F01D 5/08* (2006.01)
*F01D 5/18* (2006.01)

(52) U.S. Cl.
USPC ..... 415/116; 415/115; 416/97 R; 416/96 R; 416/96 A

(58) Field of Classification Search
USPC ..... 415/115, 116; 416/96 A, 96 R, 97 R
See application file for complete search history.

(56) References Cited

U.S. PATENT DOCUMENTS

| | | | | |
|---|---|---|---|---|
| 3,726,604 | A * | 4/1973 | Helms et al. | 415/115 |
| 4,946,346 | A * | 8/1990 | Ito | 415/115 |
| 5,484,258 | A * | 1/1996 | Isburgh et al. | 415/115 |
| 6,261,054 | B1 * | 7/2001 | Bunker et al. | 415/115 |
| 6,454,526 | B1 * | 9/2002 | Cunha et al. | 415/115 |

* cited by examiner

*Primary Examiner* — Igor Kershteyn
(74) *Attorney, Agent, or Firm* — John Ryznic

(57) ABSTRACT

A turbine stator vane with a low volume cooling circuit, the vane includes inner and outer endwall impingement cavities that feed cooling air to upward and downward flowing near wall cooling passages formed within the walls of the airfoil. The cooling passages then discharge into a collection cavity where the cooling air then flows out through trailing edge exit holes to cool the trailing edge region. The cooling passages are staggered from upward flowing to downward flowing.

11 Claims, 4 Drawing Sheets

TURBINE VANE WITH COUNTER FLOW COOLING PASSAGES

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine stator vane with a closed loop cooling circuit.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Gas turbine engine power output and cycle efficiency can be improved by reducing the total amount of cooling air and leakage air used. Less flow bleed off from the compressor for the turbine airfoil cooling results in more flow being passed through the combustor to produce working fluid.

BRIEF SUMMARY OF THE INVENTION

A turbine stator vane for a gas turbine engine, especially for a first stage turbine vane in an industrial gas turbine engine, with a cooling circuit that is a closed loop cooling circuit with the cooling air used for cooling both the airfoil and the two endwalls. A first cooling flow path produces impingement cooling on the inner endwall and then flows through radial passages in the pressure and suction side walls toward the outer diameter endwall to cool the airfoil walls, and then is discharged into an internal cooling air collection cavity. A second cooling flow path produces impingement cooling on the outer endwall and then flows through radial passages in the pressure and suction side walls toward the inner diameter endwall to cool the airfoil walls, and then is discharged into an internal cooling air collection cavity. The radial cooling passages are alternating from upward flowing to downward flowing, or are staggered with upward flowing passages located adjacent to the hot surface and the downward flowing passages located adjacent to the cool wall surface of the airfoil wall. in another embodiment, the upward flowing cooling passages could be located along the cold side of the wall. The cooling air discharged into the collection cavity is discharged through a row of exit holes located in the trailing edge region.

DETAILED DESCRIPTION OF THE INVENTION

Figure 1:
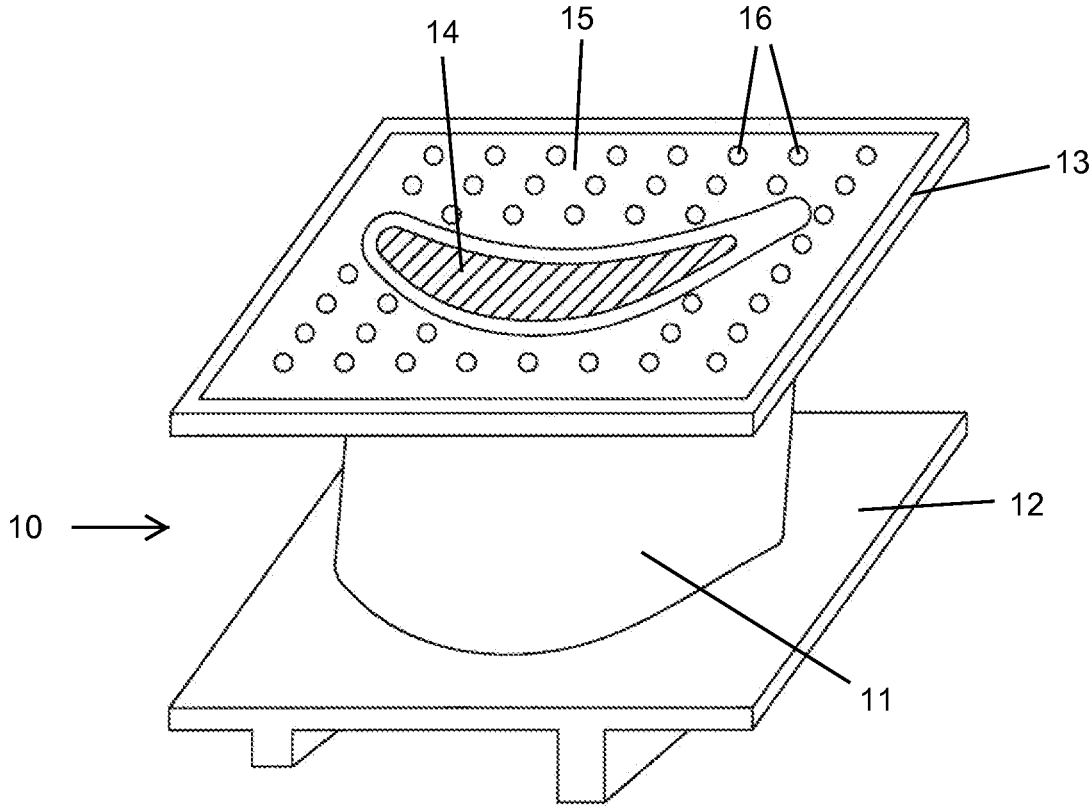
FIG. 1 shows a top view of a stator vane from the outer diameter endwall with impingement cavity of the present invention.

A turbine stator vane, especially for a first stage turbine vane used in a large frame heavy duty industrial gas turbine engine, is shown in FIG. 1 and includes an airfoil 11 extending between an inner diameter (ID) endwall 12 and an outer diameter (OD) endwall 13. FIG. 1 shows the OD endwall 13 with structural details, but the ID endwall has similar structural details. The OD endwall 13 includes an impingement cavity 15 fed by a number of impingement holes 16 spaced around to provide adequate impingement cooling to the hot side of the OD endwall 13. A hollow internal cavity of the airfoil 11 is closed off 14.

Figure 2:
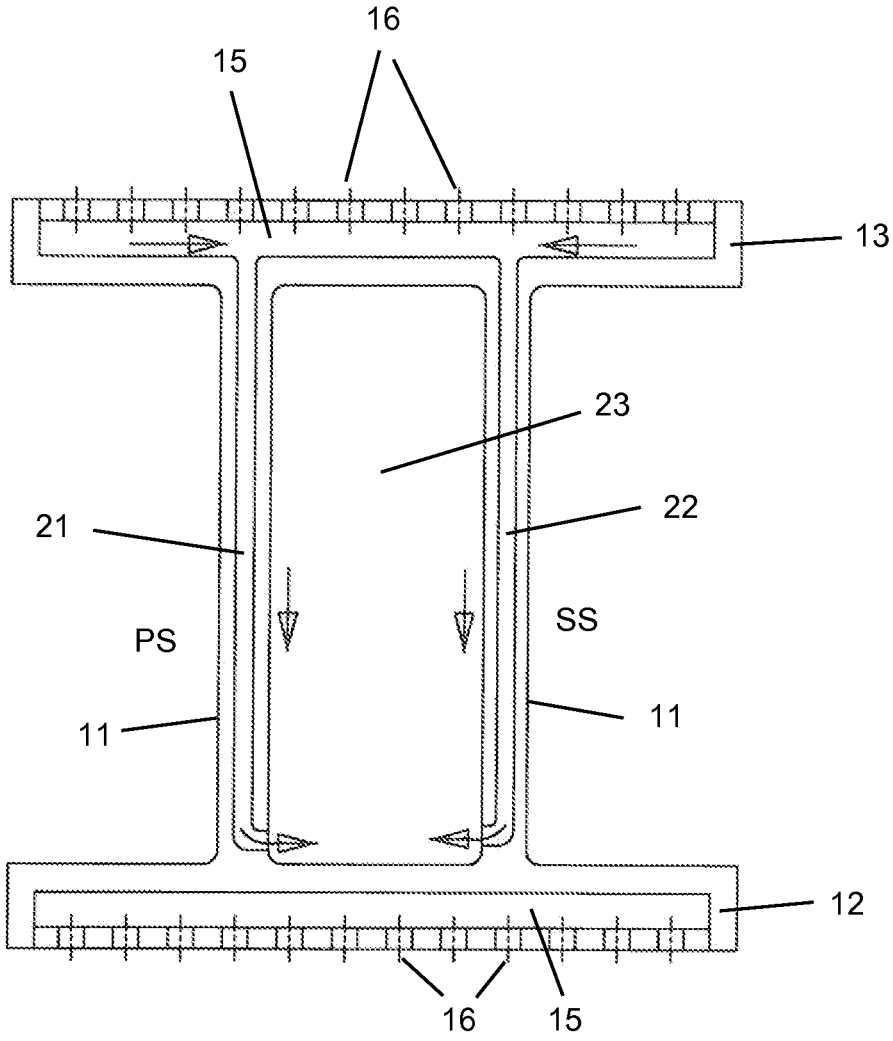
FIG. 2 shows a cross section view of the vane of the present invention with the outer diameter endwall impingement cooling circuit and the airfoil wall downward flowing cooling passages.

FIG. 2 shows a side view of the vane cooling circuit with the impingement cavity 15 formed in the OD endwall 13. The airfoil forms the hollow internal cavity that is forms a cooling air collection cavity 23. As seen in FIG. 2, the pressure side (PS) wall of the airfoil includes a number of near wall cooling passages 21, and the suction side (SS) wall includes a number of near wall cooling passages 22 in which both passages 21 and 22 flow downward or toward the ID endwall 12. The ID endwall 12 also has an impingement cavity 15 fed by a number of impingement holes 16 spaced around the endwall. Cooling air from the OD endwall impingement cavity 15 flows down the channels 21 and 22 and then into the collection cavity 23.

Figure 3:
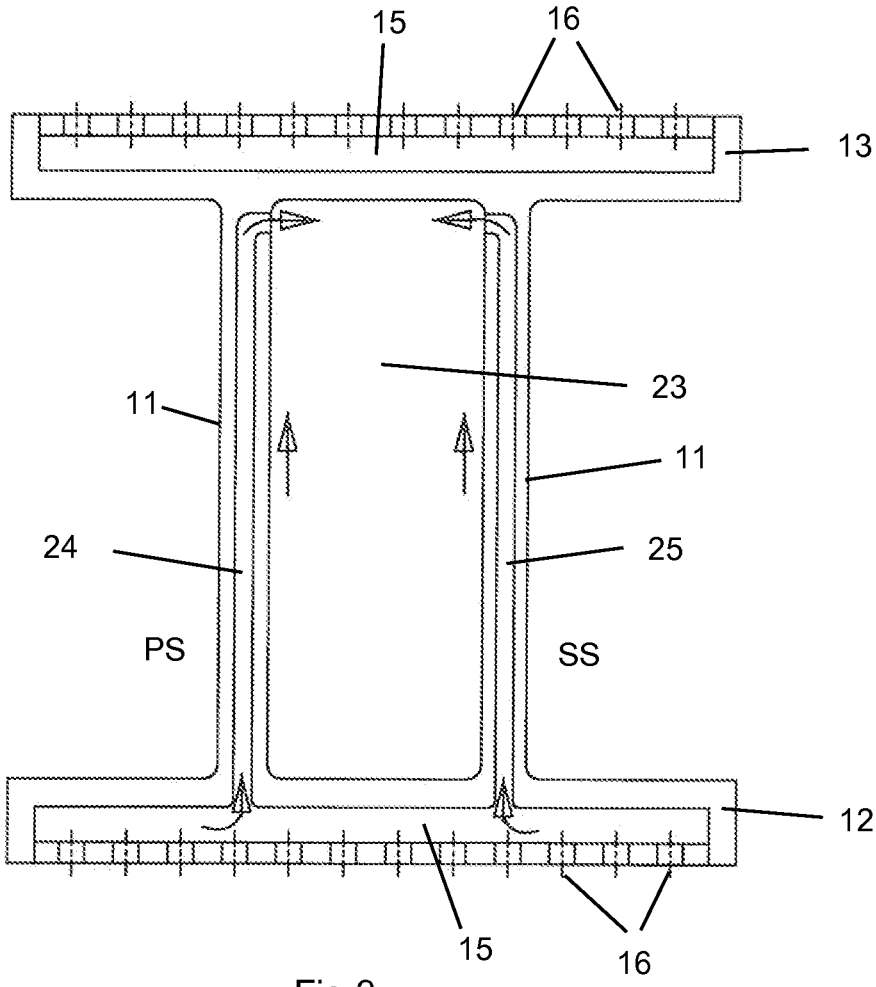
FIG. 3 shows a cross section view of the vane of the present invention with the inner diameter endwall impingement cooling circuit and the airfoil wall upward flowing cooling passages.

FIG. 3 shows the ID endwall 12 impingement cavity connected to a number of near wall cooling passages 24 formed within the pressure side wall of the airfoil 11. The suction side wall of the airfoil also has a number of near wall cooling passages 25 also connected to the ID endwall impingement cavity 15. These channels 24 and 25 are upward flowing or flowing toward the OD endwall 13. Cooling air from the ID endwall impingement cavity 15 flows up the channels 24 and 25 and then into the collection cavity 23 to merge with the cooling air from the OD endwall 13 impingement cavity.

The radial near wall cooling passages (21, 22, 24, 25) all extend within the airfoil walls from one endwall to the opposite endwall so that as much of the airfoil surface can be cooled. The radial near wall cooling passages (21, 22, 24, 25) all have a racetrack cross sectional shape in that the width is greater than a height (measured across the wall) of the passage. This provides more surface area of the cooling passage. No film cooling holes are used on the airfoil surfaces so that all of the cooling air used for impingement cooling of the endwall is used to cool the airfoil walls and then discharged through the trailing edge exit holes or slots. Therefore, the cooling circuit of the present invention is considered to be a low volume cooling circuit.

Figure 4:
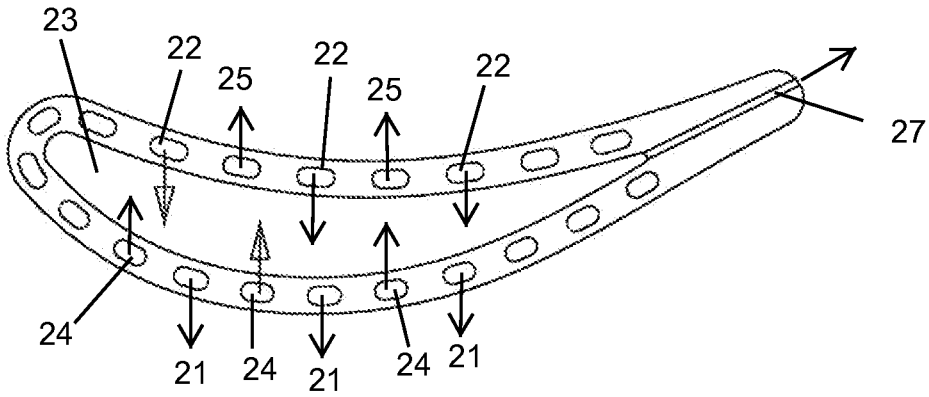
FIG. 4 shows a cross section top view of the airfoil walls with the radial cooling passages in an inline arrangement of the present invention.
Figure 5:
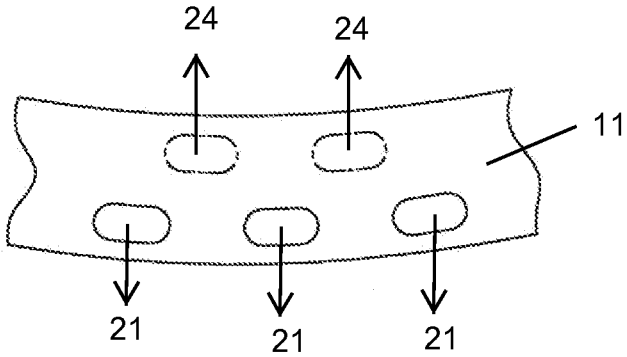
FIG. 5 shows a cross section top view of the airfoil walls with the radial cooling passages in a staggered arrangement of the present invention.

The arrangement of the near wall cooling passages (21, 22, 24, 25) can be arranged in a number of ways. FIG. 4 shows an inline arrangement in which the upward flowing channels alternate with the downward flowing channels on both side walls of the airfoil. FIG. 5 shows a staggered arrangement in which the airfoil wall includes upward flowing passages along one side of the wall and downward flowing passages one the opposite side of the wall. In the embodiment of FIG. 5, the upward flowing passages from the ID endwall 12 are arranged closer to the cool side wall while the downward flowing passages from the OD endwall are arranged closer to the hot side wall of the airfoil which is the surface of the airfoil exposed to the hot gas stream passing through the vane. Also the upward flowing passages are located across from a gap between adjacent downward flowing passages, and the downward flowing passages are located across from a gap between adjacent upward flowing passages. In another embodiment, this arrangement could be reversed in that the upward flowing passages could be located closer to the hot wall surface of the airfoil.

In operation, cooling air is passed through the endwall cavity impingement holes to provide impingement cooling for the endwalls. Pin fins can be used to enhance the heat transfer effect of the cooling air flowing around the impingement cavity. The cooling air from the impingement cavity is then passed through the near wall cooling passages to provide near wall cooling for the airfoil walls. The cooling air is then discharged into the cooling air collection cavity 23. the cooling air from the collection cavity 23 then passes through the row of exit holes 27 located along the airfoil trailing edge region that extend between the two endwalls 12 and 13. A row of exit slots that open on the pressure side wall just before the trailing edge of the airfoil can also be used to cool and discharge the cooling air through the trailing edge.

To enhance the heat transfer effect, pin fins can be used for the two endwall backside cooling within the impingement cavity 15. The radial flow cooling channels extend in a radial direction of the airfoil wall to balance the airfoil wall through-wall-gradient and to increase the cool side to hot gas side area ratio for better convection efficiency. Cooling air is impinged onto the backside of the endwall first and then channeled through the radial counter flowing passages. The cooling air from the ID endwall 12 flows toward the OD endwall 13 while the cooling air from the OD endwall 13 flows toward the ID endwall to form a counter flowing arrangement of channels that creates a more uniform metal temperature for the airfoil walls and less thermally induced stress. The spent cooling air from the collection cavity can be used to cool the airfoil trailing edge region. Trip strips or micro pin fins can be used in the counter flowing radial cooling passages to further enhance the airfoil near wall cooling performance.

As a result of the closed loop turbine cooling circuit of the present invention, the compressed bleed air provides the first stage vane endwall cooling first, then is used to cool the airfoil main body with near wall cooling, then passed through the trailing edge region to provide cooling for the trailing edge region, and then discharged from the airfoil. With this double and triple use of the cooling air, the cooling air flow is reduced and the engine power output is increased.

I claim the following:

1. A turbine stator vane comprising:

an inner diameter endwall with an inner diameter impingement cavity;

an outer diameter endwall with an outer diameter impingement cavity;

an airfoil extending between the inner diameter endwall and the outer diameter endwall;

the airfoil having a pressure side wall and a suction side wall;

a collection cavity formed between the pressure side wall and a suction side wall;

a plurality of downward flowing cooling air passages formed in the pressure side wall and a suction side wall with an inlet connected to the outer diameter impingement cavity and an outlet connected to the collection cavity; and, a plurality of upward flowing cooling air passages formed in the pressure side wall and a suction side wall with an inlet connected to the inner diameter impingement cavity and an outlet connected to the collection cavity.

2. The turbine stator vane of claim 1, and further comprising:

the plurality of downward flowing cooling air passages and the plurality of downward flowing cooling air passages extend within the walls from the inner diameter endwall to the outer diameter endwall.

3. The turbine stator vane of claim 1, and further comprising:

the plurality of cooling air passages are inline and alternating from upward flowing to downward flowing.

4. The turbine stator vane of claim 1, and further comprising:

the plurality of upward flowing cooling air passages are located along one side of the wall and the plurality of downward flowing cooling air passages are located on an opposite side of the wall.

5. The turbine stator vane of claim 4, and further comprising:

the upward flowing passages are located across the a space between adjacent downward flowing passages.

6. The turbine stator vane of claim 1, and further comprising:

a row of trailing edge exit holes connected to the collection cavity.

7. The turbine stator vane of claim 1, and further comprising:

the plurality of upward and downward flowing cooling air passages extends along the pressure side wall and the suction side wall and around the leading edge region toward the trailing edge region of the airfoil.

8. The turbine stator vane of claim 1, and further comprising:

the plurality of upward and downward flowing cooling air passages are near wall cooling passages that extend in a radial direction of the airfoil.

9. The turbine stator vane of claim 1, and further comprising:

the vane is without film cooling holes on the airfoil walls.

10. The turbine stator vane of claim 1, and further comprising:

the collection cavity is the only cavity formed between the airfoil walls from the leading edge to the trailing edge.

11. The turbine stator vane of claim 1, and further comprising:

the plurality of upward and downward flowing cooling air passages have a racetrack cross sectional shape with a width greater than a height.

* * * * *